United States Patent [19]

Weis

[11] Patent Number: 4,485,952

[45] Date of Patent: Dec. 4, 1984

[54] SHIFTABLE MAGAZINE CLIP FEED FOR FASTENER DRIVING TOOLS

[75] Inventor: Charles W. Weis, Los Angeles, Calif.

[73] Assignee: Power-Line Fastener Systems, Inc., ElMonte, Calif.

[21] Appl. No.: 384,195

[22] Filed: Jun. 3, 1982

[51] Int. Cl.[3] ..... B25C 1/04; B25C 5/16

[52] U.S. Cl. ..... 227/7; 227/10; 227/32; 227/43; 227/100; 227/116; 227/113

[58] Field of Search ..... 227/7, 8, 10, 20, 32, 227/43, 100, 114, 115, 116, 113, 120, 119

[56] References Cited

U.S. PATENT DOCUMENTS

| | | | |
|---|---|---|---|
| 2,886,815 | 5/1959 | Young | 227/120 |
| 2,923,937 | 2/1960 | Laucher | 227/114 X |
| 3,245,596 | 4/1966 | Lygo | 227/116 |
| 3,633,810 | 1/1972 | Krakauer et al. | 227/120 X |
| 3,741,455 | 6/1973 | Wandel et al. | 227/120 X |
| 3,742,577 | 7/1973 | Buttriss | 227/120 X |
| 3,891,133 | 6/1975 | Maier et al. | 227/10 |
| 4,114,792 | 9/1978 | Pomeroy | 227/10 X |
| 4,339,065 | 7/1982 | Haytayan | 227/113 X |

*Primary Examiner*—Paul A. Bell
*Attorney, Agent, or Firm*—William H. Maxwell

[57] ABSTRACT

A shiftable magazine clip feed for orienting a U-shaped clip and a staple fastener at the head of a fastener driving tool triggered after the separation of a single clip from a stacked supply thereof, the clip being automatically positioned for application to a work piece and mounted thereon through engagement of the magazine with the work piece and that retracts the stacked supply of clips from said single clip.

40 Claims, 11 Drawing Figures

FIG. 1.
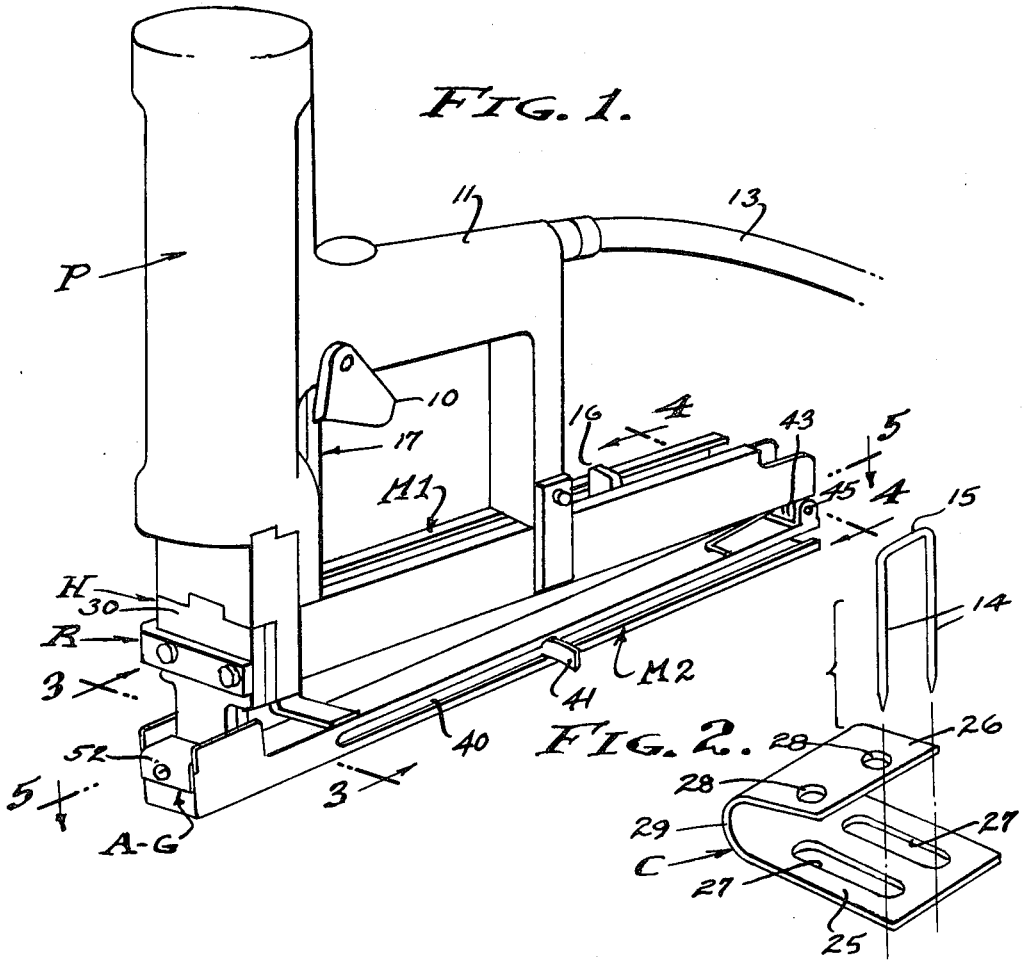
FIG. 2.
FIG. 3.
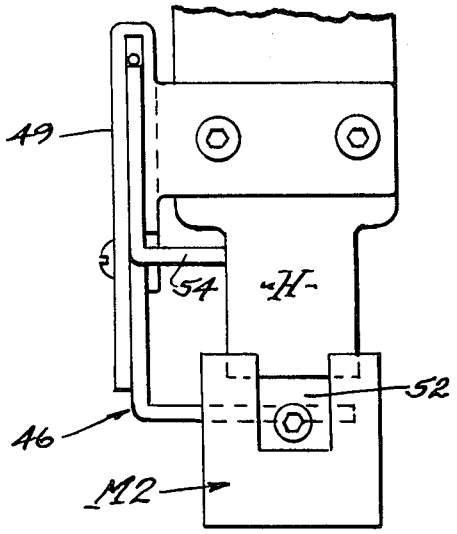
FIG. 4.
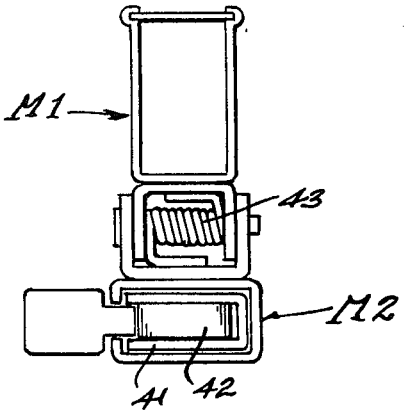

SHIFTABLE MAGAZINE CLIP FEED FOR FASTENER DRIVING TOOLS

BACKGROUND

This invention relates to the fastening of clips by means of staples and the like driven into a work piece. The particular clip which is of concern is a spring mounting clip of U-shape having diverging legs and one of which is longer than the other. These clips are used in the construction of furniture to hold spring coils and the like, and heretofore they have been installed individually by placing them manually followed by the application of a fastener driven by a hammer or by a pneumatic drive tool. Obviously, the manual hammer application and/or orientation of the pneumatic tool is time consuming. Accordingly, it is a general object of this invention to eliminate the handling and orientation of individual clips by automatically supplying them into oriented position with respect to a fastener tool during the fastener driving operation.

It is common practice to supply staples and clips from spring biased magazines carried by a single pneumatic fastener driving tool. However, the particular clip with which this invention is concerned has required individual handling, due to its U-shape and the dissimilar lengths of its two legs. Such clips are supplied as loose individual clips for manual applications, and they are stacked in columnar formation for tool application and characterized by a nesting together and overlapped formation of sequential clips. This nested and overlapping of stacked clips has required their separation in feed mechanisms which have therefore been complicated and cumbersome and not altogether conducive to use in hand carried tools where light weight and compactness is to be desired. Heretofore, forward separation of the foremost clip from the stacked supply thereof had been unobvious and overlooked, and for example typical clip feeders have separated the foremost clip laterally from the magazine supply; as disclosed by U.S. Pat. No. 2,886,815 issued to Charles L. Young, May 19, 1959, and as disclosed by U.S. Pat. No. 3,633,810 issued to Daniel Krakauer et al. Jan. 11, 1972. Consequently, the clip magazines of the prior art have had interferring relationships with respect to the fastener magazines, and all of which has required separation and angular dispositions of one magazine to the other. It is an object of this invention to provide a compact and light weight clip feeding magazine that is closely positioned and combined with a fastener magazine with which it cooperates to orient a single clip beneath a single staple for each succeeding installation of a clip fastened by a staple. With the present invention the sequential clip and magazine feed coordination is entirely automatic, as will be described.

The fastening of clips of the character herein referred to has required fastener driving tools of special head design and special fastener magazine design, in addition to the special design of a clip feeder and magazine therefor. It is an object of this invention to adapt a special clip feeding magazine without requiring a special tool head design and without requiring a special fastener magazine design. In other words, the fastener driving tool head and fastener magazine remain unchanged, and all that is necessary is several anchor attachments for adapting the clip feeder and magazine as it is hereinafter described.

Reference is made to my co-pending application Ser. No. 358,539 filed Mar. 16, 1982, entitled CLIP MAGAZINE FEED FOR FASTENER DRIVING TOOLS and issued Jan. 10, 1984 as U.S. Pat. No. 4,424,929. In that disclosure the semi-circular rear end of the clip was preceeded by the straight leading edge of the lower mounting leg thereof; the said semi-circular rear end being advanced by the following stack of clips and/or by the magazine follower, and the upper leg of the clip being stopped against the back plate of the fastener driving head of the tool. The fastener magazine and clip magazine therein are mounted rigid and parallel one with the other, and all of which necessitates a separately operable level means for retraction of the clip stack from the foremost clip. Furthermore, the said foremost clip therein is not juxtapositioned as close as it is now possible in the present invention, to the work plane when the fastener is driven therethrough. Accordingly, it is an object of this invention to closely juxtaposition the clip to the work plane in readiness for fastening, and to substantially reduce the complexity of the lever means for the retraction of the clip stack from the foremost clip. With the present invention, the clip feeding magazine is shiftable relative to the fastener driving head of the tool, it being an object in this feature to cause embracement of the U-shaped clip with the projecting head of the tool. A feature as later described is the positioning of the clip by the magazine, and reversal of the clip stack, so that the semi-circular end of the clip preceeds the straight edge of the lower mounting leg. In other words, as disclosed herein the clip is said to have a semi-circular front end and trailing upper and lower legs with rear edges respectively.

It is an object of this invention to adapt the aforesaid clip feeding magazine close to the fastener magazine, adjacent thereto and in alignment below said fastener magazine. In practice, the preferred clip feeding magazine is side opening for travel of the stack pusher and manual access thereto. However, it is to be understood that top and bottom opening magazines are also feasible.

It is an object of this invention to separate the foremost clip from the columnar stacked supply thereof, preceeding the trigger actuation that operates the drive tool. With the present invention a lever means is operated by engagement of the magazine against the work piece, which retracts said columnar stack of clips from the said foremost clip to be secured. The said foremost clip is held positioned for receiving the fastener by gripper means and attractor means, as will be described.

It is an object to provide a clip magazine feed for fastener driving tools which is light weight and comprised of a minimum of simple and dependable parts that are accessible for maintenance while being protected as required in order to prevent damage thereto. Operation thereof is positive and trigger actuation of the drive tool is manual or timed, as desired, so that proper penetration of the clip by the fastener is ensured.

SUMMARY OF INVENTION

A power tool is provided with closely adjacent relatively shiftable magazines and one underlying the other. In practice, a clip feeding magazine is secured beneath the fastener magazine and shiftable relative to the driving head of a conventional fastener driving tool, it being a general object of this invention to secure one leg of a U-shaped clip onto a work piece by the application of a staple. Accordingly, the fastener magazine overlies the clip magazine from which a single clip is sequentially separated for its individual mounting onto the work piece by means of driving a staple therethrough. Although the clip mounting by means of staples is described herein, it is to be understood that securement by means of other types of fasteners is applicable, as for example by means of T-nails driven through a single opening or slot through the clip. A feature of this invention is the retraction of the supply stack of clips from the said separated or individual clip to be mounted. Another feature is the coordinated separation of a clip and/or separation of the supply stack with the driving action of the tool. In practice, a pneumatic staple driving tool is employed with its trigger actuated manually, or coordinated with the clip feed means when so desired, the latter being actuated by engagement with the work piece when offering up the foremost clip that is separated and positioned by and within the forward end of the clip magazine to embrace the head of the fastener driving tool. This invention resides in the clip feeding magazine and clip embracement of the tool head when juxtapositioned to the work piece, all in timed relation with the operation of the fastener driving tool, in this instance a staple driving tool.

The foregoing and other various objects and features of this invention will be apparent and fully understood from the following detailed description of the typical preferred form and application thereof, throughout which description reference is made to the accompanying drawings.

FIG. 1 is a perspective view of a fastener driving tool with the clip magazine and feeder of the present invention adapted thereto.

FIG. 2 is an enlarged perspective view of the clip and fastener relationship within the tool prior to driving the fastener through slots in the clip.

FIG. 3 is an enlarged front elevational view showing the driving head of the tool and the clip magazine applied thereto with the retraction means at the side thereof, taken as indicated by line 3—3 on FIG. 1.

FIG. 4 is an enlarged rear elevational view showing the clip and fastener magazine relationship, taken as indicated by line 4—4 on FIG. 1.

Figure 11:
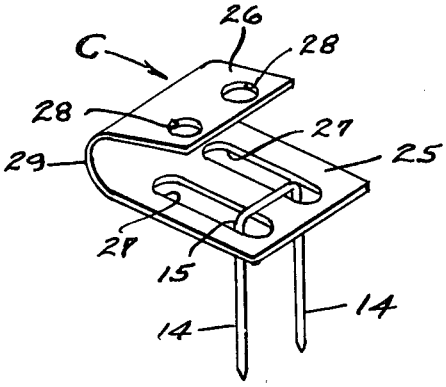

And, FIG. 11 is a view similar to FIG. 2 showing the clip and fastener relationship after driving the fastener through the clip and into the work piece.

PREFERRED EMBODIMENT

Referring now to the drawings, the power tool is shown as an air powered device comprised of cylinder and piston means P disposed on a vertical axis and operable through a trigger 10 on a handle 11 to reciprocate a driver blade B through a driveway 12. Compressed air for operation of the tool is supplied through a hose 13. The piston and driver blade operate to have an explosive driving stroke downwardly into engagement with the endmost fastener or staple S of a stick thereof and continuing so as to deliver the head or crown of the fastener at a driving plane x offset below the driving head of the tool. The work part or clip C to be penetrated and mounted presents its surface at said driving plane x where the legs or shanks 14 of the staple fastener S pass through openings in the clip and enter into the work piece to be secured and stabilized thereby. The head or crown 15 is driven into bearing engagement with the body of the clip C to engage it tightly to the work piece. As shown, the staple S has a pair of parallel and pointed shanks 14 of equal length. The stick supply of staples is formed by securing a multiplicity of identical staples in columnar formation as by means of a tape or destructable adhesive that yields to the shear force applied when the driver blade strikes an individual staple to sever it from the next remaining staple of the stick.

The clip C is peculiar to the present invention, being a U-shaped member of sheet metal having a lower mounting leg 25 greater in length than an upper leg 26. This clip is especially adapted to the fastening of springs to furniture frames and is characterized by a pair of notches or openings and preferably a pair of slots 27 in the lower leg aligned with a pair of holes 28 in the upper leg as shown. The upper leg stops short so as to expose the openings or slots in the lower leg for the passage of the staple shanks 14 therethrough, thereby to mount the clip in accordance with this invention, and prior to the subsequent securement of a spring (not shown). In practice, clip C of the type under consideration is fabricated of sheet steel with slightly divergent legs 25 and 26 joined by a semi-circular end 29 integral therewith, and all of which is designed to be constricted to embrace the spring when a second staple fastener is applied through said holes and slots and into the work piece. However, it is only the first driven staple fastener S with which this invention is concerned, that which secures the lower leg 25 through the exposed ends of the slots 27.

A head H and fastener magazine M1 supported thereby are carried by the cylinder and piston means P. The aforesaid driveway is incorporated in the head H for the delivery of individual staples sheared from the magazine M1 feeding thereto through an opening in a back plate 20, covered by a front plate 30. Characteristically, the magazine M1 extends normal to and rearward from the driveway plane, a substantial distance to carry a good supply of staples. A spring pressed follower 16 operates toward the head to force the stick supply forwardly into engagement with the front plate 30 which forms the front wall of the driveway. The cross section of the driveway accommodates the cross section of the staple S with some clearance, and so that an individual staple S can be delivered through the driveway with each forward stroke of the driver blade B. The pneumatic cylinder and piston (not shown) is provided to drive and retract the driver blade for each operation of the tool. The operational features and details thereof are conventional with respect to constructing the tool, the trigger 10 being exposed for manual actuation, and there being a "bump" valve control 17 responsive to shifting of the clip magazine M2 engageable with the work piece as later described.

Figure 5:
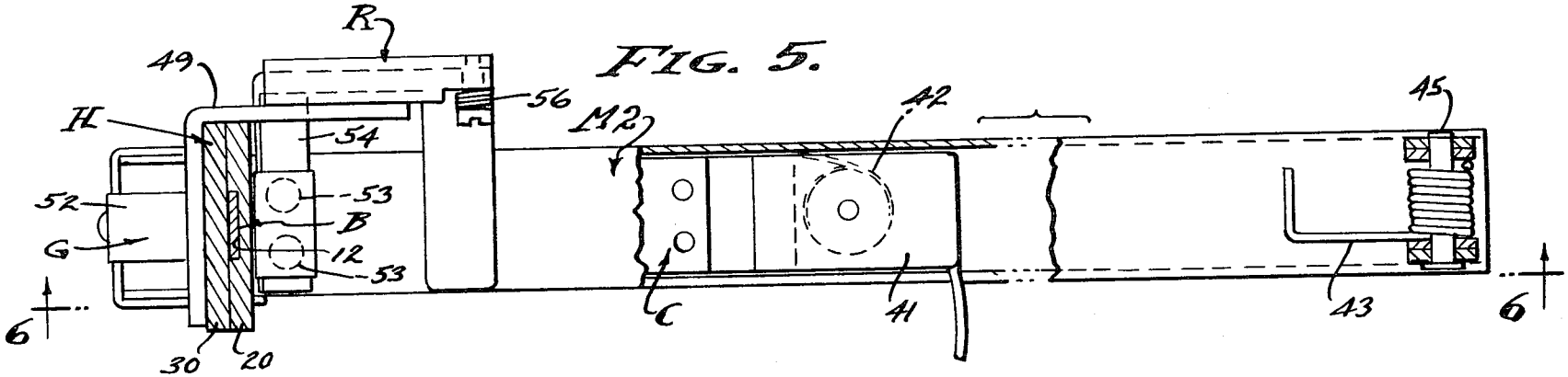
FIG. 5 is an enlarged plan sectional view showing the clip magazine and retraction means at the side thereof, taken as indicated by line 5—5 on FIG. 1.
Figure 6:
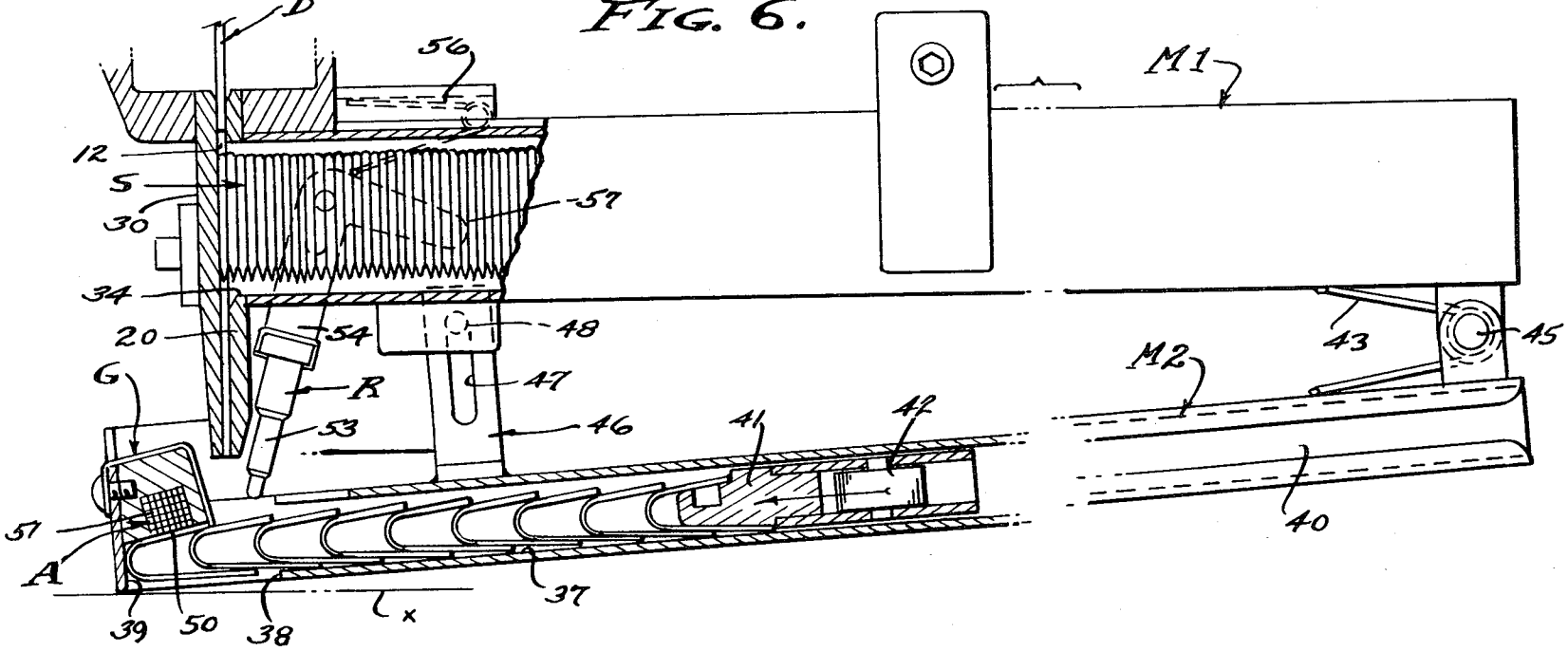
FIG. 6 is a side elevational view with portions broken away to show in section, taken as indicated by line 6—6 on FIG. 5.

Referring to the magazine M1, the staples S in stick formation are slideably carried therein with points down. The magazine M1 is typically of rectangular cross section having a top and sides slideably engaging the crowns 15 and shanks 14 of the staples. As shown in FIGS. 4 and 6, the magazine M1 is a sheet metal channel fitted at its forward end to an opening 34 in the back plate 20 so as to feed the staples S into the driveway. The front plate 30 limits one staple at a time to enter said driveway with the staple crown exposed to the driver blade so as to be driven thereby. Note that the head H comprised of the plates 20 and 30 depends a substantial distance below the magazine M1 thereby extending the driveway opening to be embraced by the successive clips C delivered forwardly by the magazine M2 next to be described.

Referring now to the magazine M2, the clips C in columnar stacked formation are slideably carried therein with their legs 25 and 26 projecting rearwardly and with their semi-circular ends 29 faced forwardly and embraced one within the legs of the next preceeding clip. In practice, the clips C are entered into the magazine M2 in said columnar stacked loose formation from a feed tube type packaging in which they are supplied. The lower mounting legs 25 are supported upon a bottom wall 37 having a front edge 38 spaced back from the back plate 20, as shown, to provide a clip delivery opening. Three walls of the magazine housing are imperforate, and one side of the housing presents an open slot 40,.the housing having a rectangular cross sectional configuration to freely pass and guide a follower 41 that pushes the columnar stack of clips C. In its preferred form, the magazine housing is of the side opening C-shape configuration shown in FIGS. 4 and 10, with imperforate walls and with the slotted side wall defined by spaced inwardly turned flanges forming the slot 40. The rearmost end of the housing is open for the reception of the clips C, and the follower 41 is manually retractable and biased by a spring 42 to press the follower 41 toward the closed forward end of the magazine and forcing the columnar stack of clips C forwardly and into engagement with the rear face of the front wall 39 of the magazine. A feature of this invention is that it is the front semi-circular end 29 of the clip which has stopped engagement with the front wall 39 of the magazine M2, the clip C passing freely beneath the head H and subsequently embraced thereby as will be described. The embracement of the clip C with the head H is shown clearly in FIG. 9 of the drawings.

The magazine M1 is attached to the head H of the tool, and is stabilized by a bracket so as to extend laterally from the cylinder and piston means P of the tool, and as shown in the drawings the magazine M2 is closely positioned beneath and in alignment with magazine M1. In accordance with this invention the magazine M1 for staples S is rigid with and at a right angle to the head H and driveway therethrough, and the magazine M2 of clips C is shiftable from and held spaced below the magazine M1 by spring means 43. A feature is that the foremost clip C, as it is shown in FIG. 6, passes beneath the head H and underlies the same when the magazine M2 is shifted downwardly by spring means 43.

Shifting of magazine M2 is preferably by means of a scissors action with respect to the fixed magazine M1, and as shown the remote ends of the two magazines are hinged one to the other by a pivot 45 and sprung apart by the spring of means 43. A feature of the tool is that the head H projects below the magazine M1 and the foremost clip C in the magazine M2 is disposed below the staple delivery opening of the head when the stack of clips C is advanced by the spring 42, and as shown in the preferred form magazine M2 is disposed divergently below the magazine M1 and head H.

Figure 9:
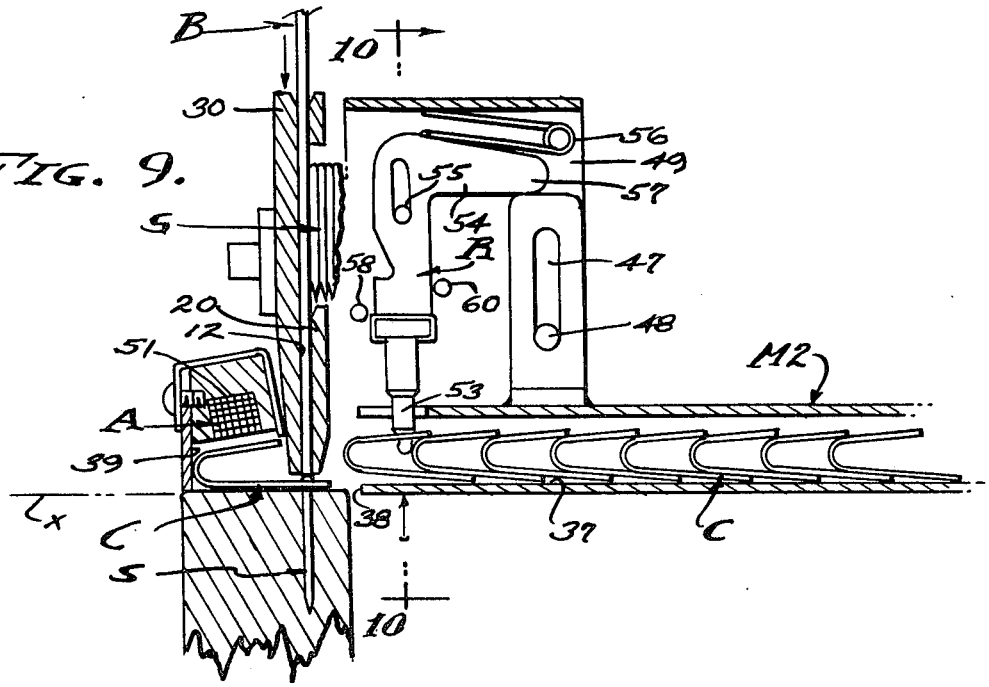
Figure 10:
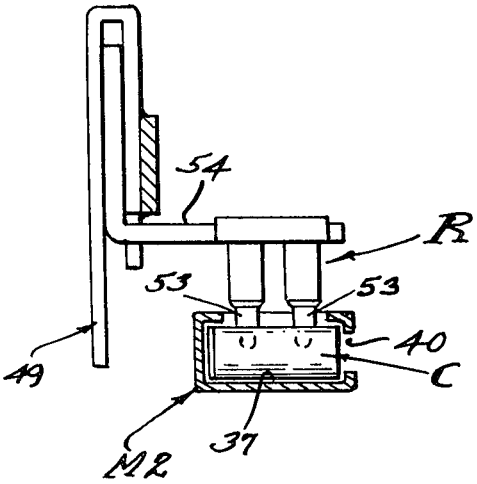
FIG. 10 is a detailed sectional view showing the retraction means as it is associated with the clip magazine, taken as indicated by line 10—10 on FIG. 9.

The movement of magazine M2 is restricted by stop means 46 to said divergent position shown in FIG. 6 and to the depressed position shown in FIG. 9, preferably by means of a slotted member having a slot 47 operating over a stop pin 48. The pin 48 is carried by a side plate 49 fixed to the head H, the slot 47 limiting downward positioning of magazine M2 as shown in FIG. 6, and limiting upward positioning of magazine M2 as shown in FIG. 9. The slot 47 and pin 48 are spaced rearward of the head H, and the upward limit of movement places the magazine M2 parallel with the magazine M1.

In accordance with this invention, attraction means A and gripper means G are provided to retain the foremost clip C in the aforesaid stopped position against the front wall 39 of the magazine M2, and with its bottom leg 25 juxtaposed to and parallel with the bottom plane of the magazine wall 37 engageable flat against a workpiece. Accordingly, the foremost clip C in said columnar stack formation yields to a "breaking" action (see FIGS. 6 and 7) of a cam face 50 that engages the upper leg of the clip when the spring pressed follower 41 forces the columnar stack of clips into stopped engagement with the rear of the front wall 39. A feature is that the bottom leg 25 of the foremost clip C in this initial "breaking" is positioned parallel to the plane of the work piece, and is held in this position by the attractor means A in the form of a permanent magnet 51 secured to the front wall 39 and flush with the cam face 50 to locate the leg 26. Thus, the divergent upper leg 26 breaks away from that of the next succeeding clip C to be then engaged by the gripper means G shown herein as a leaf spring 52 positioned so as to engage the rear edge of the leg 26 of said foremost clip when it is in said stopped position. The leaf spring 52 has an arm 52' (see FIG. 8) that moveably engages flat against the back of the cam that positions leg 26 of the clip, and projects from the cam face 50 from which it is depressible upwardly to pass each succeeding clip. The rear edge of leg 26 of the foremost clip C retained by the attraction means A and gripper means G working in cooperation with means A and G are forward of the head H, while the lower leg 25 underlies the head H. The top wall of magazine M2 stops short of and rearwardly of the head H for access of the retraction means R next described. Separation is initiated, separation of the columnar stack of clips from the foremost clip, with the overlapped relation with the foremost clip and next succeeding clip remaining.

In accordance with this invention, retraction means R is provided to withdraw the columnar stack of clips C from the stopped and retained foremost clip C. The retraction means R is shown as one or more pawls 53 that shift or move between advanced and retracted positions, to be released from and to engage with and retract the columnar stack of clips C. In carrying out this invention, the pawls 53 are depressible pin members that engage into the above described hole or holes 28 in the upper leg 26 of the clip C. The depressible pawl pins 53 are carried on a lever and preferably a bellcrank lever 54 shiftably pivoted upon a fulcrum 55, so as to remain engaged with a clip C following the foremost clip C and so as to retract the stack of remaining clips in response to and while the magazine M2 is depressed into parallelism with the magazine M1. The fulcrum 55 comprises a pin carried by the side plate 49, to the side of and rearward of the head H, the bellcrank lever 54 being slotted vertically and with spring means 56 pressing downwardly thereon so as to have an extended forwardly rotated position (see FIG. 6) when the magazine M2 is positioned downwardly by the spring means 43, and so as to have a raised position when the magazine M2 is positioned parallel with magazine M1 (see FIGS. 9 and 10). There are other intermediate positions as will be described.

Figure 7:
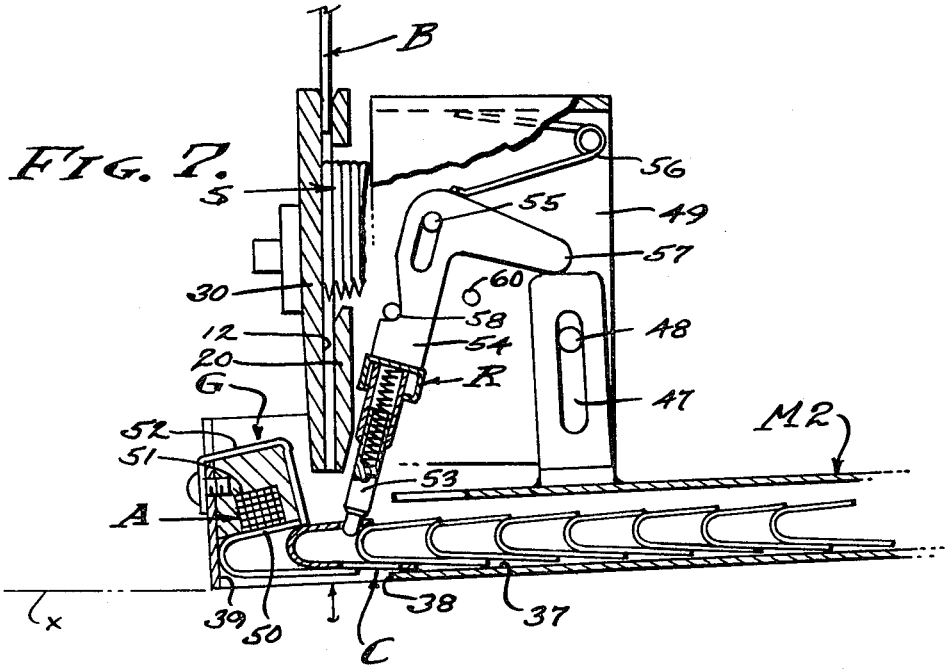
FIGS. 7, 8 and 9 are detailed sectional views similar to the sectioned portion of FIG. 6, showing the sequential functions of the retraction means which characterizes this invention.

The purpose of the bellcrank lever 54 and of the pawl or pawls and pins 53 is to retract the remaining stack of clips C from the foremost clip C stopped and held positioned by the attraction means A and gripper means G. Accordingly, the top wall of the magazine M2 stops rearward of the head H so that the pawl pins 53 have access to the top legs 26 and the openings 28 therein, the pins 53 per se being spring extended telescoping shouldered members, as shown in FIG. 7, that stop against the clip C following the foremost clip and that depress as the magazine M2 is moved into parallelism with magazine M1.

In accordance with this invention, the stack retracting pawl or pawls and pins 53 are operated by the movement of magazine M2 into and or toward parallelism with magazine M1, and to this end the slotted leg of stop means 46 is employed to shift an overlying leg 57 of said bellcrank lever 54. It will be observed that the slotted member of means 46 and lever or leg 57 are spaced when the magazine M2 is extended, as in FIG. 6. However, the leg 57 is engage when the magazine M2 is depressed into the position shown in FIG. 7, for initial engagement of the pawl pins 53 into the openings 28 through the second clip C. To ensure this action, the bellcrank lever 54 is initially prevented from turning by means of a latch pin 58 engageable with a forwardly open shouldered notch formed in the depending leg. When the bellcrank 54 is depressed and rotated forwardly by the spring means 56, the shouldered notch engages the latch pin 58 which prevents raising of the bellcrank lever 54 while engaging the pawl pin 53 into the clip leg holes 28. Continued movement of the slotted leg 47 engages leg 57 of the bellcrank 54 lever to turn it and thereby release the shouldered notch from the latch pin 58. A stop 60 is provided on the side plate 49 to limit rearward movement of bellcrank lever 54 and travel of the pawl pin or pins 53, so that retraction of the stack of clips is limited to that position shown in FIGS. 8 and 9.

Figure 8:
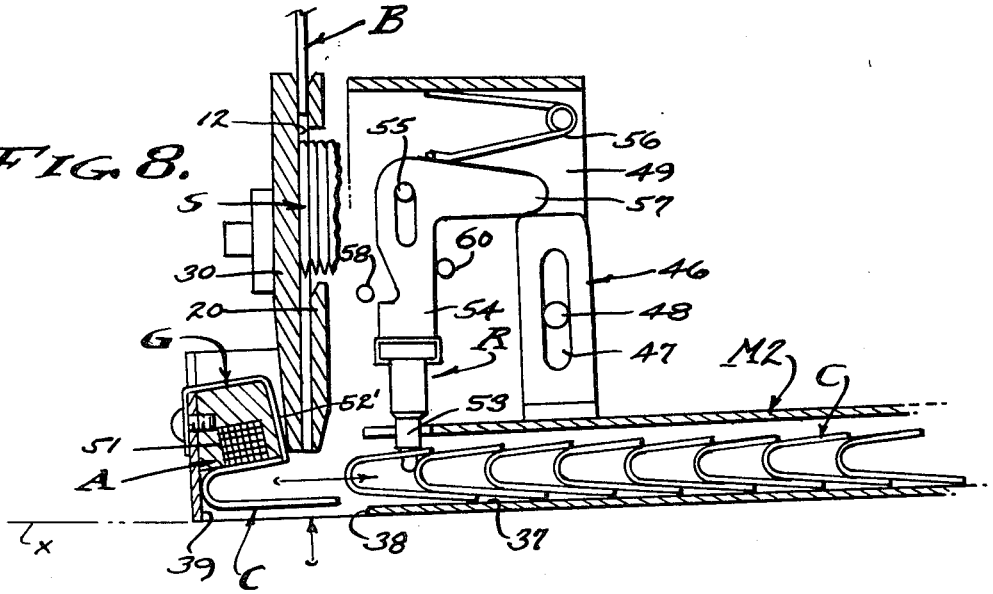

From the foregoing it will be seen that the major members are limited basically to the magazine M2 and bellcrank lever 54. The pawl pins 53 are yielding depressible members, and all of which operate inherently as follows: Firstly and as shown in FIG. 6, the magazine M2 extended by the spring means 43 permits feeding of the stack of clips C up to the front wall 39 where the foremost clip C stops with its leg 25 beneath the head H and with the rear portion of the slot 27 aligned with the staple driveway of the tool. Secondly and as shown in FIG. 7, initial depression of the magazine M2 by engagement with the workpiece causes the pawl pins 53 to have shouldered engagement with the clip openings 28, and to take up the slack between the leg of stop means 46 and bellcrank lever 54. Thirdly and as shown in FIG. 8, further depression of the magazine M2 against the workpiece causes the bellcrank lever 54 to shift the pawl pins 53 rearwardly causing retraction of the stack of clips C from the foremost clip C held by the attraction means A and gripper means G, the slot 47 permitting this continued shifting of the magazine M2. Fourthly and as shown in FIG. 9, complete depression of the magazine M2 into parallelism with the magazine M1 causes the head H to enter behind the upper leg 26 and into engagement with the lower leg 25, to be embraced by the foremost clip C. Lastly, the tool is actuated to drive the staple S from the magazine M1 and through the driveway and into opening or openings 27 aligned therewith, as shown in FIG. 9, to thereby install the said foremost clip C onto the workpiece. Withdrawal of the tool from the workpiece allows return of the magazine M2 to the position shown in FIG. 6 where the stack of clips C is again advanced into stopped engagement with the front wall 39 of the magazine M2 preparatory to another cycle of operation, as described.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A tool for the application of a clip to a work piece by means of a fastener, the clip being of U-shape with a rearwardly extending lower mounting leg of greater length than an overlying upper leg for vertical exposure of an opening through the lower mounting leg for receiving the fastener, and including in combination; a first fastener magazine means carried by the tool and the tool having a driveway through a head projecting to a driving plane offset from said first fastener magazine means and through which driveway a driver blade reciprocates to sever a fastener from a supply thereof advanced by said first fastener magazine means and to deliver the same through said driving plane and into the work piece, and a second work piece engageable clip magazine means shiftably carried beneath the first fastener magazine means and extending beneath and open to receive the head of the tool and to sequentially stop a foremost clip of a nested stack of clips with the lower mounting leg thereof underlying the head and with the opening therethrough substantially aligned with the driveway through the head, means holding and preventing retraction of said foremost clip from said alignment with the driveway, a normally advanced retraction means withdrawing the stack of clips from the foremost clip when positioned relative to the work piece for application of the clip thereto, and means operating the driver blade to sever and deliver a fastener through the opening in the lower mounting leg of the foremost clip and fastening the same onto the work piece.

2. The clip feed and fastener driving tool as set forth in claim 1, wherein a declining cam in the second clip magazine means engages and depresses the upper leg of the foremost clip to rotate said clip relative to the nested stack of succeeding clips to initially break away therefrom.

3. The clip feed and fastener driving tool as set forth in claim 1, wherein the upper and lower legs of the U-shaped clips are divergent, and wherein a declining cam in the second clip magazine means engages and depresses the upper leg of the foremost clip to rotate said clip relative to the nested stack of succeeding clips and initially breaking the nested engagement of the foremost clip.

4. The clip feed and fastener driving tool as set forth in claim 1, wherein the means holding and preventing retraction of said foremost clip includes a magnet engageable with the foremost clip when in said stopped engagement with a front wall of the second clip magazine means.

5. The clip feed and fastener driving tool as set forth in claim 1, wherein the means holding and preventing retraction of said foremost clip includes a depressible spring member with a forwardly faced edge yieldingly biased thereby into engagement with the foremost clip in said stopped engagement with a front wall of the second clip magazine means.

6. The clip feed and fastener driving tool as set forth in claim 1, wherein the means holding and preventing retraction of said foremost clip includes, a depressible spring member with a forwardly faced edge yieldingly biased thereby into engagement with the upper leg of the foremost clip, and a magnet engageable with the foremost clip when in said stopped engagement with a front wall of the second clip magazine means.

7. The clip feed and fastener driving tool as set forth in claim 1, wherein the normally advanced retracting means comprises a pawl engageable with the upper leg of the next succeeding clip nested with the foremost clip and means engageable with the work piece to shift the pawl between advanced and retracted positions.

8. The clip feed and fastener driving tool as set forth in claim 1, wherein the normally advanced retracting means comprises a pawl engageable with the upper leg of the next succeeding clip nested with the foremost clip and shiftable between advanced and retracted positions in response to shifting of the second clip magazine means by its engagement with the work piece.

9. The clip feed and fastener driving tool as set forth in claim 1, wherein the normally advanced retraction means comprises a lever engaged by and moved in response to shifting of the second clip magazine means by its engagement with the work piece, and a pawl carried by the lever and engageable with the upper leg of the next succeeding clip nested with the foremost clip to retract the nested stack of clips from the foremost clip when the lever is moved.

10. The clip feed and fastener driving tool as set forth in claim 1, wherein the normally advanced retraction means comprises a lever engaged by and moved in response to shifting of the second clip magazine means by its engagement with the work piece, a stop means limiting shifting of the second clip magazine means between a feed position where the foremost clip underlies the head of the tool and a drive position where the lower leg of the foremost clip engages the head of the tool, and a pawl carried by the lever and engageable with the upper leg of the next succeeding clip nested with the foremost clip to retract the nested stack of clips from the foremost clip when the lever is moved.

11. The clip feed and fastener driving tool as set forth in claim 1, wherein the normally advanced retraction means comprises a lever engaged by a member shifting with the second clip magazine means by its engagement with the work piece, a stop means limiting shifting of the second clip magazine means between a feed position where the foremost clip underlies the head of the tool and a drive position where the lower leg of the foremost clip engages under the head of the tool, and a pawl carried by the lever and engageable with the upper leg of the next succeeding clip nested with the foremost clip to retract the nested stack of clips from the foremost clip when the lever is moved.

12. The clip feed and fastener driving tool as set forth in claim 1, wherein the normally advanced retraction means comprises a lever engaged by a slotted member shifting with the second clip magazine means by its engagement with the work piece, stop means comprised of a fixed stop engageable in a slot of said slotted member and limiting shifting of the second clip magazine means between a feed position where the foremost clip underlies the head of the tool and a drive position where the lower leg of the foremost clip engages under the head of the tool, and a pawl carried by the lever and engageable with the upper leg of the next succeeding clip nested with the foremost clip to retract the nested stack of clips from the foremost clip when the lever is moved.

13. The clip feed and fastener driving tool as set forth in any one of claims 11 or 12, wherein the normally advanced retraction means includes a bellcrank with a first leg carrying the pawl and a second leg engaged with the said member.

14. The clip feed and fastener driving tool as set forth in any one of claims 11 or 12, wherein the lever of the normally advanced retraction means is shiftable on a fulcrum to move with the shifting of the second magazine means and member thereof engaged with said lever.

15. The clip feed and fastener driving tool as set forth in any one of claims 11 or 12, wherein the lever of the normally advanced retraction means is a bellcrank shiftable on a fulcrum and with a first leg carrying the pawl and a second leg engaged with the member of and shifting with the second magazine means.

16. The clip feed and fastener driving tool as set forth in any one of claims 11 or 12, wherein the lever is yieldingly urged to said advanced condition of the retraction means by a spring.

17. The clip feed and fastener driving tool as set forth in any one of claims 11 or 12, wherein the lever of the normally advanced retractions means is shiftable on a fulcrum to move with the shifting of the second clip magazine means and member thereof engaged with said lever, and wherein the lever is yieldingly urged by spring means to said advanced condition of the retraction means where it is engaged by a latch member received in a recess of the lever having an upwardly faced shoulder engageable therewith to prevent shifting of the lever when in said advanced position.

18. The clip feed and fastener driving tool as set forth in any one of claims 11 or 12, wherein the lever of the normally advanced retraction means is a bellcrank shiftable on a fulcrum and with a first leg carrying the pawl and a second leg engaged with the member of and shifting with the second clip magazine means, and wherein the lever is yieldingly urged by spring means to said advanced condition of the retraction means where it is engaged by a latch member received in a recess of the lever having an upwardly faced shoulder engageable therewith to prevent shifting of the lever when in said advanced position.

19. The clip feed and fastener driving tool as set forth in any one of claims 11 or 12, wherein the pawl is depressible and comprises a telescoping spring biased member engageable with the upper leg of the clip.

20. The clip feed and fastener driving tool as set forth in any one of claims 1 through 12, wherein the second clip magazine means is carried by the first fastener magazine means at a pivot remote from the head of the tool, and biased by a spring to shift to a normally extended position with the foremost clip spaced from and beneath the head of the tool.

21. The clip feed and fastener driving tool as set forth in any one of claims 1 through 12, wherein the fastener driving tool is power operated with a manually actuable trigger means actuating cylinder and piston means upon contact with the work piece to reciprocate the driver blade.

22. A tool for the application of a clip to a work piece by means of a staple, the staple being of inverted U-shape with a pair of like spaced and parallel shanks to penetrate into the work piece, and the clip being of horizontal U-shape with a rearwardly extending lower mounting leg of greater length than an overlying upper leg for vertical exposure of a pair of like and parallel openings spaced to pass the pair of spaced staple shanks opening through the lower mounting legs and including in combination; a first fastener magazine means carried by the tool and the tool having a driveway through a head projecting to a driving plane offset from said first staple magazine means and through which driveway a driver blade reciprocates to sever a staple from a supply thereof advanced by said first staple magazine means and to deliver the same through said driving plane and into the work piece, and a second work piece engageable clip magazine means shiftably carried beneath the first staple magazine means and extending beneath and open to receive the head of the tool and to sequentially stop a foremost clip of a nested stack of clips with the lower mounting leg thereof underlying the head and with the opening therethrough substantially aligned with the driveway through the head, means holding and preventing retraction of said foremost clip from said alignment with the driveway, a normally advanced retraction means withdrawing the stack of clips from the foremost clip when positioned relative to the work piece for applciation of the clip thereto, and means operating the driver blade to sever and deliver a staple and driving the pair of shanks thereof through the pair of openings through the lower mounting leg of the foremost clip and fastening the same onto the work piece.

23. The clip feed and staple driving tool as set forth in claim 22, wherein a declining cam in the second clip magazine means engages and depresses the upper leg of the foremost clip to rotate said clip relative to the nested stack of succeeding clips to initially break away therefrom.

24. The clip feed and staple driving tool as set forth in claim 22, wherein the upper and lower legs of the U-shaped clips are divergent, and wherein a declining cam in the second clip magazine means engages and depresses the upper leg of the foremost clip to rotate said clip relative to the nested stack of succeeding clips and initially breaking the nested engagement of the foremost clip.

25. The clip feed and staple driving tool as set forth in claim 22, wherein the means holding and preventing retraction of said foremost clip includes a magnet engageable with the foremost clip when in said stopped engagement with a front wall of the second clip magazine means.

26. The clip feed and staple driving tool as set forth in claim 22, wherein the means holding and preventing retraction of said foremost clip includes a depressible spring member with a forwardly faced edge yieldingly biased thereby into engagement with the foremost clip in said stopped engagement with a front wall of the second clip magazine means.

27. The clip feed and fastener driving tool as set forth in claim 22, wherein the means holding and preventing retraction of said foremost clip includes, a depressible spring member with a forwardly faced edge yieldingly biased thereby into engagement with the upper leg of the foremost clip, and a magnet engageable with the foremost clip when in said stopped engagement with a front wall of the second clip magazine means.

28. The clip feed and staple driving tool as set forth in claim 22, wherein the normally advanced retracting means comprises a pawl engageable with the upper leg of the next succeeding clip nested with the foremost clip and means engageable with the work piece to shift the pawl between advanced and retracted positions.

29. The clip feed and staple driving tool as set forth in claim 22, wherein the normally advanced retracting means comprises a pawl engageable with the upper leg of the next succeeding clip nested with the foremost clip and shiftable between advanced and retracted positions in response to shifting of the second clip magazine means by its engagement with the work piece.

30. The clip feed and fastener driving tool as set forth in claim 22, wherein the normally advanced retraction means comprises a lever engaged by a member shifting with the second magazine means by its engagement with the work piece, a stop means limiting shifting of the second clip magazine means between a feed position where the foremost clip underlies the head of the tool and a drive position where the lower leg of the foremost clip engages under the head of the tool, and a pawl carried by the lever and engageable with the upper leg of the next succeeding clip nested with the foremost clip to retract the nested stack of clips from the foremost clip when the lever is moved.

31. The clip feed and fastener driving tool as set forth in claim 22, wherein the normally advanced retraction means comprises a lever engaged by a slotted member shifting with the second clip magazine means by its engagement with the work piece, stop means comprised of a fixed stop engageable in a slot of said slotted member and limiting shifting of the second clip magazine means between a feed position where the foremost clip underlies the head of the tool and a drive position where the lower leg of the foremost clip engages under the head of the tool, and a pawl carried by the lever and engageable with the upper leg of the next succeeding clip nested with the foremost clip to retract the nested stack of clips from the foremost clip when the lever is moved.

32. The clip feed and fastener driving tool as set forth in any one of claims 30 or 31, wherein the normally advanced retraction means includes a bellcrank with a first leg carrying the pawl and a second leg engaged with the said member.

33. The clip feed and fastener driving tool as set forth in any one of claims 30 or 31, wherein the lever of the normally advanced retraction means is shiftable on a fulcrum to move with the shifting of the second clip magazine means and member thereof engaged with said lever.

34. The clip feed and fastener driving tool as set forth in any one of claims 30 or 31, wherein the lever of the normally advanced retraction means is a bellcrank shiftable on a fulcrum and with a first leg carrying the pawl and a second leg engaged with the member of and shifting with the second clip magazine means.

35. The clip feed and fastener driving tool as set forth in any one of claims 30 or 31, wherein the lever is yeildingly urged to said advanced condition of the retraction means by a spring.

36. The clip feed and fastener driving tool as set forth in any one of claims 30 or 31, wherein the lever of the normally advanced retraction means is shiftable on a fulcrum to move with the shifting of the second clip magazine means and member thereof engaged with said lever, and wherein the lever is yeildingly urged by spring means to said advanced condition of the retraction means where it is engaged by a latch member received in a recess of the lever having an upwardly faced shoulder engageable therewith to prevent shifting of the lever when in said advanced position.

37. The clip feed and fastener driving tool as set forth in any one of claims 30 or 31, wherein the lever of the normally advanced retraction means is a bellcrank shiftable on a fulcrum and with a first leg carrying the pawl and a second leg engaged with the member of and shifting with the second clip magazine means, and wherein the lever is yieldingly urged by spring means to said advanced condition of the retraction means where it is engaged by a latch member received in a recess of the lever having an upwardly faced shoulder engageable therewith to prevent shifting of the lever when in said advanced position.

38. The clip feed and fastener driving tool as set forth in any one of claims 30 or 31, wherein the pawl is depressible and comprises a telescoping spring biased member engageable with the upper leg of the clip.

39. The clip feed and fastener driving tool as set forth in any one of claims 22 through 31, wherein the second clip magazine means is carried by the first staple magazine means at a pivot remote from the head of the tool, and biased by a spring to shift to a normally extended position with the foremost clip spaced from and beneath the head of the tool.

40. The clip feed and fastener driving tool as set forth in any one of claims 22 through 31, wherein the fastener driving tool is power operated with a manually actuable trigger means actuating cylinder and piston means upon contact with the work piece to reciprocate the driver blade.

* * * * *